US008265325B2

(12) United States Patent
Park

(10) Patent No.: US 8,265,325 B2
(45) Date of Patent: Sep. 11, 2012

(54) EARPHONE DEVICE FOR PORTABLE TERMINAL

(75) Inventor: Chan-Yeol Park, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 1100 days.

(21) Appl. No.: 11/969,064

(22) Filed: Jan. 3, 2008

(65) Prior Publication Data

US 2008/0159579 A1 Jul. 3, 2008

(30) Foreign Application Priority Data

Jan. 3, 2007 (KR) ..... 10-2007-0000539

(51) Int. Cl.
*H04R 25/00* (2006.01)

(52) U.S. Cl. ..... 381/374; 381/370; 381/371; 381/379; 381/380; 381/384

(58) Field of Classification Search ..... 381/370–371, 381/374, 379–380, 384
See application file for complete search history.

(56) References Cited

U.S. PATENT DOCUMENTS

| | | | | |
|---|---|---|---|---|
| 2,641,327 | A * | 6/1953 | Balmer | 181/129 |
| 3,671,685 | A * | 6/1972 | McCabe | 381/382 |
| 6,945,663 | B2 * | 9/2005 | Chien | 362/84 |
| 2005/0220319 | A1 * | 10/2005 | Chan et al. | 381/374 |
| 2006/0034477 | A1 * | 2/2006 | Lazzeroni et al. | 381/376 |
| 2007/0036376 | A1 * | 2/2007 | Fried | 381/312 |

FOREIGN PATENT DOCUMENTS

| | | |
|---|---|---|
| JP | 2001-326712 | 11/2001 |
| KR | 20-2000-009666 | 6/2000 |
| KR | 20-0228427 | 4/2001 |
| KR | 20-0245063 | 8/2001 |
| KR | 20-0356185 | 7/2004 |
| KR | 20-040074 | 10/2005 |

OTHER PUBLICATIONS

English Translation of KR 20-2000-0009666 U, Jeong, Device for Preventing Tangling of Ear-Phone Wires, Jun. 5, 2000.*
English Translation of KR 20-0228427, Jang, Necklace-Type Hand Free Device of Portable Termainl, Apr. 12, 2001.*
English Translation of KR 20-0356185, Kim, Ear-Microphone Receiving Accessory Cap Applied to Mobile Communication Terminal, Jul. 5, 2004.*

* cited by examiner

*Primary Examiner* — Mohamad Musleh
*Assistant Examiner* — Tsz Chan
(74) *Attorney, Agent, or Firm* — The Farrell Law Firm, P.C.

(57) ABSTRACT

An earphone device for a portable terminal, including a body connected to the terminal; an earphone having a pair of ear speakers, a connection plug, and a cable joining the ear speakers to the connection plug; a fixed member fixedly positioned on the cable; and a coupling member adapted to slide on the cable while surrounding overlapping portions of the cable, which is bent at the fixed member. The cable between the coupling member and the fixed member is used as a strap of the terminal when the ear speakers are mounted on the body. This makes it possible to carry the terminal conveniently and prevents the cable from being tangled.

5 Claims, 3 Drawing Sheets

EARPHONE DEVICE FOR PORTABLE TERMINAL

PRIORITY

This application claims priority under 35 U.S.C. §119(a) to an application filed in the Korean Intellectual Property Office on Jan. 3, 2007 and assigned Serial No. 2007-000539, the contents of which are incorporated herein by reference.

BACKGROUND OF THE INVENTION

1. Field of the Invention

The present invention generally relates to a portable terminal, and more particularly to an earphone device for a portable terminal, which can improve the portability of the terminal.

2. Description of the Related Art

As generally known in the art, the development of information communication technology has caused the appearance of portable terminals with various functions and shapes, including bar-type terminals, flip-type terminals having a flip cover, and folder-type terminals having a folder adapted to fold on and unfold away from the body within an angular range.

In addition to the basic function of voice communication with desired partners, portable terminals incorporate various additional functions, including transmission/receipt of emails or data, Internet games, text transmission, etc. Furthermore, newly introduced communication technology, such as High Speed Downlink Packet Access (HSDPA), has expanded the range of services, including video communication between terminal users and moving image services.

A portable terminal basically includes a strap and an earphone. The strap is connected to the terminal and provides the user of the terminal with the convenience of carrying the terminal. Straps are generally classified into hand straps, which are configured as handles grasped by users with hands, and neck straps, which are configured as necklaces worn around the neck. The earphone enables the user of the terminal to conduct voice communication or enjoy sounds and voices from various multimedia contents, such as music files, moving image files, etc.

The strap is connected to the terminal via a recess formed on the terminal, and the earphone is selectively connected to the terminal via a jack formed on the terminal.

However, conventional earphones have a problem in that, when an earphone is simply carried, the cable of the earphone can become tangled, making the earphone inconvenient to use. Furthermore, neatening up the cable is tedious and bothersome regardless of whether or not the earphone is connected to the terminal. In addition, the portability of the terminal is adversely affected because the earphone and strap are separately connected to the terminal.

SUMMARY OF THE INVENTION

Accordingly, the present invention solves the above-mentioned problems occurring in the prior art and provides at least the advantages described below. It is an aspect of the present invention to provide an earphone device for a portable terminal, which makes it possible to carry both the terminal and the earphone, and which prevents the earphone cable from being tangled.

It is another aspect of the present invention to provide an earphone device for a portable terminal, which uses the cable of the earphone as a strap so the terminal can be conveniently carried.

In order to accomplish these aspects of the present invention, there is provided an earphone device for a portable terminal, including a body connected to the terminal; an earphone having a pair of ear speakers, a connection plug, and a cable joining the ear speakers to the connection plug; a fixed member fixedly positioned on the cable; and a coupling member adapted to slide on the cable while surrounding overlapping portions of the cable, the cable being bent at the fixed member, wherein the cable between the coupling member and the fixed member is used as a strap of the terminal when the ear speakers are mounted on the body.

BRIEF DESCRIPTION OF THE DRAWINGS

The above and other features, aspects, and advantages of the present invention will be more apparent from the following detailed description taken in conjunction with the accompanying drawings, in which:

FIG. 4 is a perspective view of ear speakers separated from the body shown in

FIG. 3.

DETAILED DESCRIPTION OF THE PREFERRED EMBODIMENTS

Preferred embodiments of the present invention will be described below with reference to the accompanying drawings. In the following description of the present invention, descriptions of known functions and configurations incorporated herein are omitted to avoid making the subject matter of the present invention unclear.

FIGS. 1-4 show an earphone device 100 for a portable terminal according to the present invention. The earphone device 100 includes a body 101 and an earphone 102.

Figure 3:
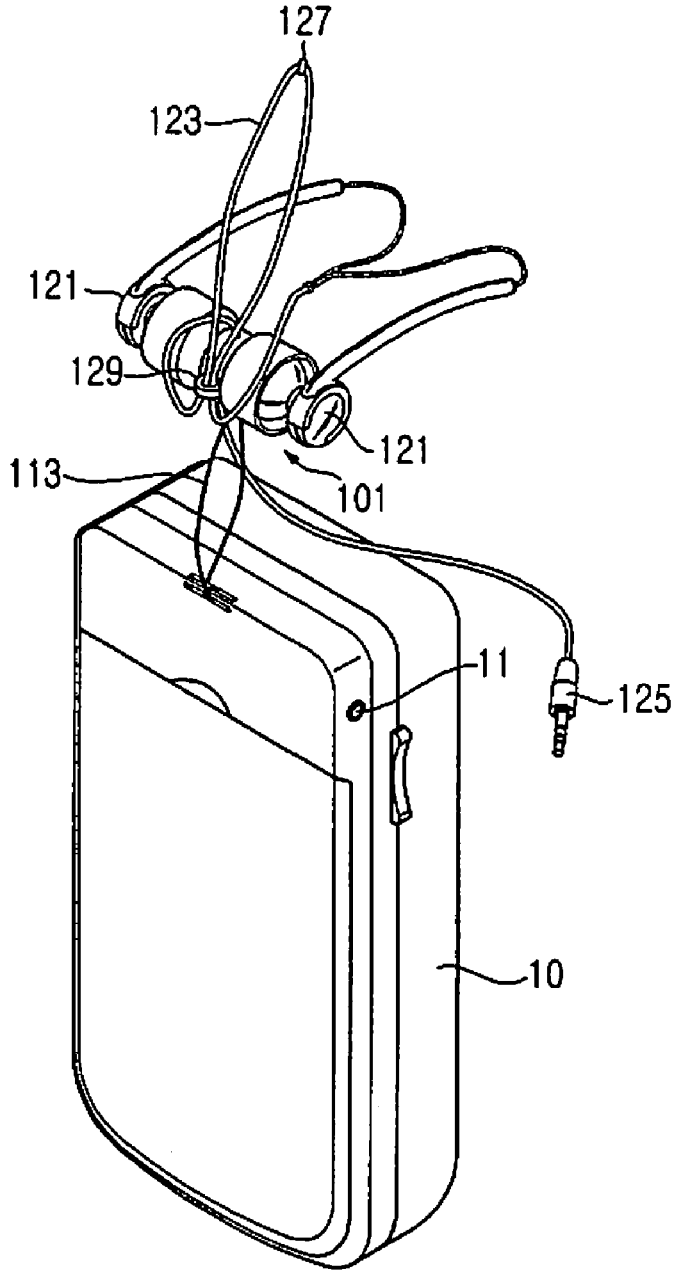
FIG. 3 is a perspective view of a portable terminal, to which the earphone device shown in FIG. 1 is coupled.

As shown in FIG. 3, the body 101 is connected to a terminal 10 and is coupled to the earphone 102. The body 101 includes mounting means 111, a connection member 113, an opening means 115, and a coupling recess 117.

The mounting means 111 are formed by denting both end surfaces of the body 101 in opposite directions. The connection member 113 has the shape of a closed loop, which extends from the outer peripheral surface of the body 101 and is fastened to the terminal 10. The opening means 115 extends through the body 101 near the connection member 113. The coupling recess 117 is formed by denting a portion of the outer peripheral surface of the body 101 so the body 101 does not interfere with the opening means 115.

The earphone 102 is coupled to the body 101 so the earphone 102 can be used as a strap, and provides a user with sound signals supplied from the terminal 10. The earphone 102 includes ear speakers 121, a connection plug 125, a cable 123, a fixed member 127, and a coupling member 129.

The ear speakers 121 are configured so they can be inserted into and mounted on the mounting means 111. In particular, when the ear speakers 121 are not used, they are mounted on the mounting means 111 and received in the body 101 so the ear speakers 121 are protected from the outside.

The ear speakers 121 convert sound signals, which are supplied from the terminal 10, into sounds and output the sounds to the user. When a user wears the pair of ear speakers 121 on both ears, he/she can hear not only mono sounds, but also stereo sounds, which are provided by the terminal 10.

The connection plug 125 is inserted into a connection socket 11, which is formed on a lateral surface of the terminal 10, and is connected to the terminal 10 so sound signals are transmitted from the terminal 10 to the ear speakers 121 via the cable 123.

One end of the cable 123 is attached to the ear speakers 121, and the other end is attached to the connection plug 125 so the ear speakers 121 are connected to the connection plug 125 via the cable 123. The cable 123 extends through the body 101 via the opening means 115. When viewed from the outside, that the connection plug 125 is positioned on an end of the cable 123, which extends from the body 101.

The body 101 can slide on the cable 123 via the opening means 115. Therefore, the length of the cable 123 between the connection plug 125 and the body 101 can be adjusted as desired. In other words, the user can adjust the distance between the connection plug 125 and the body 101 according to the circumstances.

The cable 123 transmits sound signals from the connection plug 125 to the ear speakers 121, which convert the transmitted sound signals into sounds and outputs the sounds.

The fixed member 127 is fixedly positioned on the cable 123.

The coupling member 129 is adapted to slide on the cable 123 while surrounding overlapping portions of the cable 123, which is bent at the fixed member 127. The coupling member 129 is made of rubber so the coupling member 129 is fastened and fixed to the cable 123 when no external forces act on the coupling member 129. When the coupling member 129 slides on the cable 123, the coupling member 129 interferes with the ear speakers 121 or the fixed member 127 so the range of movement of the coupling member 129 is limited to the span between the ear speakers 121 and the fixed member 127. As such, the coupling member 129 maintains a portion of the cable 123 in the shape of a closed loop, and the length of the loop portion varies as the coupling member 129 slides.

That is, the length of the portion of the cable 123, which maintains the shape of a closed loop, depends on the position of the coupling member 129. More particularly, the closer the coupling member 129 is to the fixed member 127, the smaller the area defined by the loop portion of the cable 123 becomes. When the coupling member 129 slides on the cable 123 towards the ear speakers 121, the loop portion becomes longer (i.e. the area defined by the loop portion increases).

When the ear speakers 121 are mounted on the mounting means 111 and when the coupling member 129 is positioned near the ear speakers 121, the cable 123 acts as a strap of the terminal 10.

The coupling recess 117 has a shape corresponding to the coupling member 129 so the coupling member 129 can be coupled to the coupling recess 117. When the coupling member 129 is coupled to the coupling recess 117 near the ear speakers 121, the cable 123 acts as a strap of the terminal 10, together with the body 101.

Figure 1:
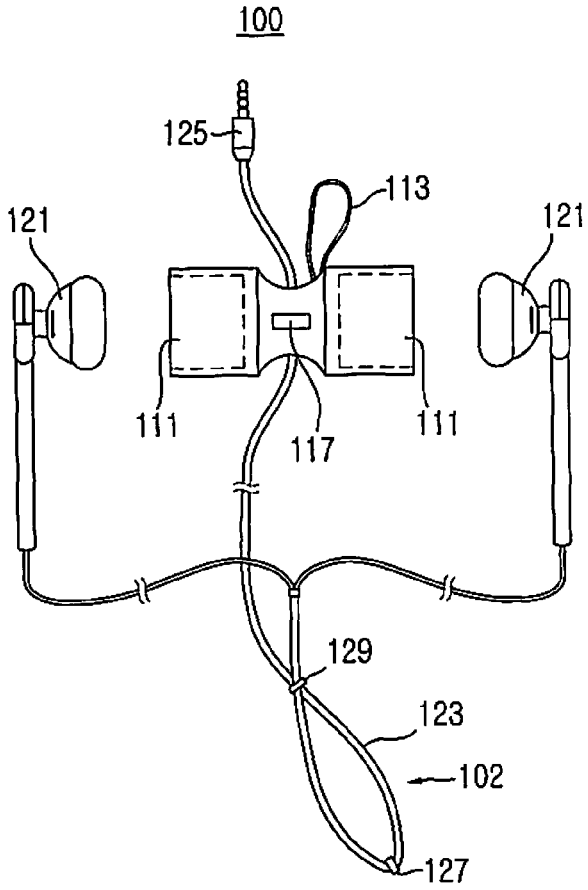
FIG. 1 is a top view of an earphone device for a portable terminal according to the present invention.
Figure 2:
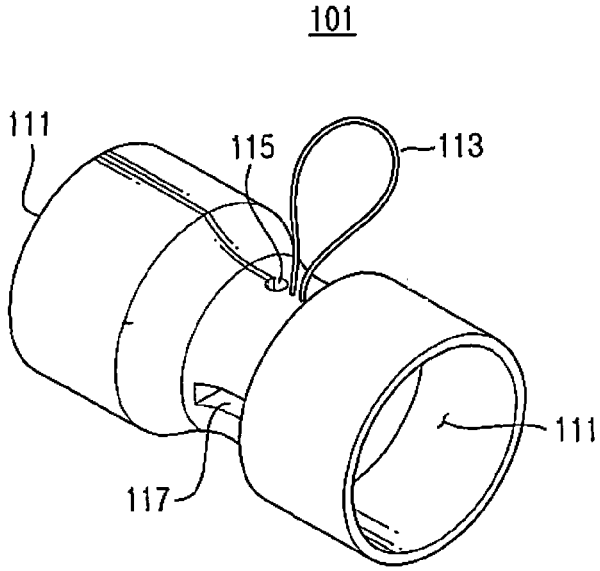
FIG. 2 is a perspective view of the body of the earphone device shown in FIG. 1.
Figure 4:
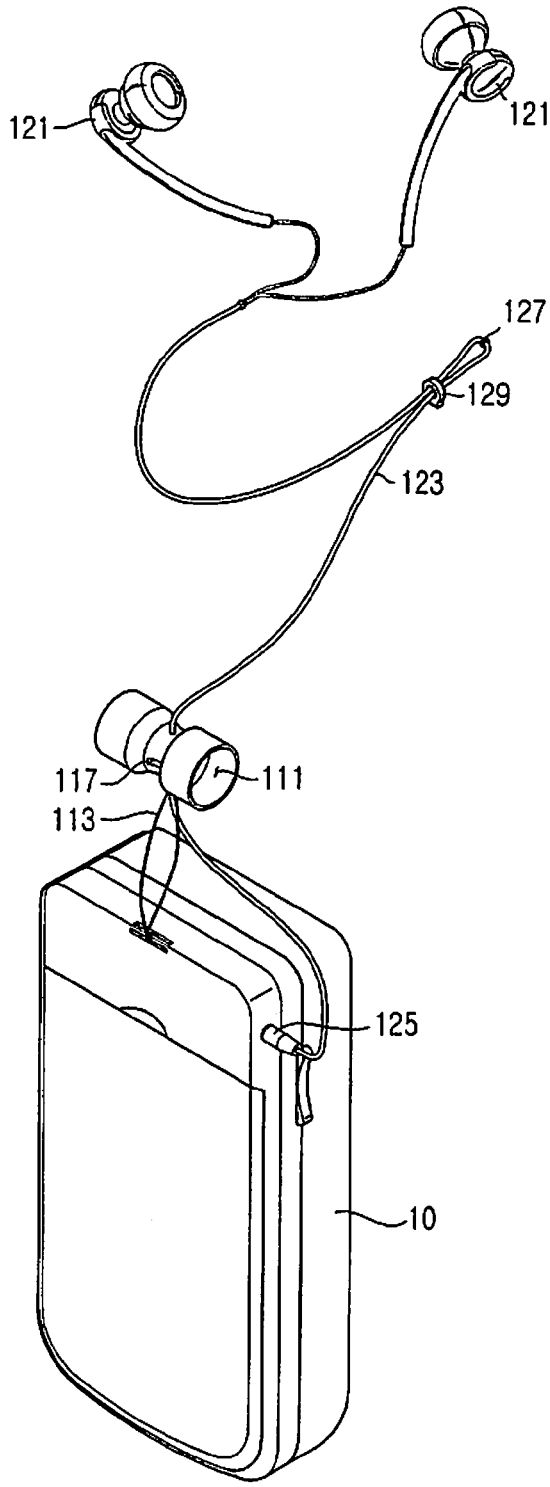

FIG. 3 shows the portable terminal 10, to which the earphone device 100 shown in FIG. 1 is coupled, and FIG. 4 shows the ear speakers 121 separated from the body 101 shown in FIG. 3. As shown in FIGS. 3 and 4, the earphone device 100 is fastened to the terminal 10 by using the connection member 113, and the terminal 10 is joined to the ear speakers 121 by using the cable 123, which also acts as a strap.

The ear speakers 121 of the earphone device 100, which is constructed as mentioned above, are mounted on the mounting means 111 and received in the body 101. By positioning the coupling member 129 near the ear speakers 121 so the loop portion of the cable 123 becomes longer and by inserting the coupling member 129 into the coupling recess 117 so as to be fixed thereto, the cable 123 acts as a strap of the terminal 10. Depending on the length, the cable 123 acts either as a handle-type strap or as a necklace-type strap.

After the ear speakers 121 are separated from the mounting means 111 and after the coupling member 129, which constrains the cable 123, is detached from the coupling recess 117 and slid towards the fixed member 127, the user can wear the ear speakers 121 on both ears and hear sounds provided by the terminal 10. If necessary, the coupling member 129 may be moved to modify the length of the cable 123.

In addition, the body 101 may be slid on the cable 123 to secure a length sufficient to connect the connection plug 125 to the connection socket 11 of the terminal 10.

As mentioned above, the earphone device for a portable terminal according to the present invention includes a body and an earphone, the ear speakers of which are mounted on the body. In particular, the fixed member, which is fixed on the cable, and the coupling member, which slides on the cable while surrounding overlapping portions of the cable bent at the fixed member, make it possible to adjust the length of the cable. Besides the role of transmitting signals, the cable also acts as a strap of the terminal. As such, the earphone device enables convenient terminal portability and prevents the cable from being tangled.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An earphone device for a portable terminal, the earphone device comprising:
- a body connected to the terminal;
- an earphone having a pair of ear speakers, a connection plug, and a cable joining the ear speakers to the connection plug;
- a fixed member fixedly positioned on the cable; and
- a coupling member adapted to slide on the cable while surrounding overlapping portions of the cable, the cable being bent at the fixed member,
- wherein the coupling member is capable of coupling or uncoupling with the body,
- wherein when the coupling member couples with the body, the cable between the coupling member and the fixed member is used as a strap of the terminal when the ear speakers are mounted on the body, and
- wherein the body has a coupling recess formed by an indentation in a portion of an outer peripheral surface of the body in a shape corresponding to a shape of the coupling member, and the coupling member is selectively inserted into and fixed to the coupling recess.

2. The earphone device as claimed in claim 1, wherein the body comprises a pair of mounting means formed by denting both end surfaces of the body; a connection member extending from an outer peripheral surface of the body to be fastened to the terminal; and an opening means extending through the body near the connection member, the cable extends through the opening means, and the ear speakers are mounted on the mounting means.

3. The earphone device as claimed in claim 2, wherein a length of the cable between the connection plug and the body is adjusted by sliding the body on the cable via the opening means.

4. The earphone device as claimed in claim 1, wherein a length of the cable between the fixed member and the coupling member is adjusted so the cable is used as a handle or a necklace by sliding the coupling member on the cable.

5. The earphone device as claimed in claim 1, wherein the coupling member is made of rubber.

* * * * *